US005280824A

United States Patent [19]

Eslinger et al.

[11] Patent Number: 5,280,824

[45] Date of Patent: Jan. 25, 1994

[54] SEALING ELEMENT FOR INFLATABLE PACKER

[75] Inventors: David M. Eslinger, Broken Arrow; Robert M. Sorem, Tulsa, both of Okla.

[73] Assignee: Dowell Schlumberger, Houston, Tex.

[21] Appl. No.: 981,441

[22] Filed: Nov. 25, 1992

[51] Int. Cl.[5] ..... E21B 33/127

[52] U.S. Cl. ..... 166/187; 166/191

[58] Field of Search ..... 166/187, 191, 179, 118, 166/120, 387

[56] References Cited

U.S. PATENT DOCUMENTS

| | | | |
|---|---|---|---|
| 3,837,947 | 9/1974 | Malone | 156/69 |
| 4,424,861 | 1/1984 | Carter, Jr. et al. | 166/187 X |
| 4,796,707 | 1/1989 | Halbardier | 166/187 X |
| 4,832,120 | 5/1989 | Coronado | 166/187 |
| 5,020,600 | 6/1991 | Coronado | 166/187 X |
| 5,143,154 | 9/1992 | Mody et al. | 166/187 |
| 5,205,567 | 4/1993 | Quinlan et al. | 166/187 X |

*Primary Examiner*—Thuy M. Bui

*Attorney, Agent, or Firm*—Stephen A. Littlefield

[57] ABSTRACT

The outer, sealing cover of an inflatable packer comprises an alternating series of thick and thin annular portions which act to effect greater sealing stresses and to inhibit the propagation of cracks or tears in the elastomeric cover. Bonding with only portions of the underlying slats as well as a tapered contour and spacing from an end fitting act to help to retain the cover in its proper position during running and retrieval as well as decreasing the likelihood of the development of cracks and/or tears.

12 Claims, 3 Drawing Sheets

SEALING ELEMENT FOR INFLATABLE PACKER

This invention relates to the art of production of subterranean fluid through a wellbore and more particularly, to an inflatable packer or bridge plug useful in temporarily isolating portions of a wellbore.

BACKGROUND OF THE INVENTION

Inflatable packers or bridge plugs have long been used in wellbore operations. An inflatable packer typically comprises a tubular base and a surrounding, inflatable elastomeric bladder or sleeve. Fluid passages within the tubular body allow fluids to contact the inflatable bladder and expand the bladder radially outwardly to effect sealing engagement with a borehole or well casing.

Since the elastomeric bladder is subjected to both expansion pressure and abrasion or cutting forces, it has been common to surround the exterior surface of the bladder with a plurality of peripherally overlapping, resilient reinforcing slats or ribs. There is generally sufficient overlap of such slats that upon expansion of the inflatable bladder, the slats remain as a surrounding armor protecting the bladder from abrasion and cuts while also preventing extrusion of the bladder elastomer between the slats in a localized area.

Because the slats cannot effect the sealing of the packer against a wellbore or casing, at least some portions of the reinforcing slats are surrounded by and may be bonded to an outer annular elastomeric cover or packing element which, upon expansion of the inflatable packer, comes into pressure sealing engagement with the wellbore or casing.

The outer sealing cover generally comprises either a single or a plurality of annular circumferential elastomeric pieces located on the outer surface of the reinforcing slats. When a single elastomeric piece is employed it may cover only a portion of the longitudinal length of the slats or, alternatively, it may cover the entire outer surface of the slats. Such single piece covers generally have a uniform thickness along their length, the thickness generally being substantial. Such arrangements are described in U.S. Pat. Nos. 3,837,947, 4,832,120 and 5,143,154.

One difficulty with uniformly thick covers is that once a tear or crack develops in the cover, it propagates rapidly over the cover, ultimately resulting in failure of the cover to maintain a seal after more than its initial cycle of use. The failure due to propagation of cracks or cuts over the cover is not ameliorated in multiple piece covers. Multiple piece covers are similarly of a single thickness which does nothing to arrest or retard the propagation of cracks or cuts within the body of a cover piece.

Bonding of the cover to the slats is desirable particularly in a retrievable packer. However, the bonding of the cover to the slats creates yet another source of stress on the cover elastomer as the packer is inflated. Cracks or tears in the cover can result merely as a consequence of inflation and stresses created by the bonding of the cover to the underlying slats which are experiencing flexure and separation.

An additional difficulty with uniform thickness outer covers is that after a typical inflation/deflation cycle of the packer, the exposed blunt ends of the cover can easily be caught in a subsequent running or retrieval movement of the packer resulting in a tearing or pulling off of the cover.

SUMMARY OF THE INVENTION

The present invention provides for a elastomeric packer cover which more effectively remains bonded to the underlying armor/slat structure, resists propagation of cracks and tears while effecting a proper seal in inflated condition and avoiding an exposed lip which could be caught resulting in a tear or removal of the cover during subsequent running or retrieval operations.

In accordance with the invention, an inflatable packer comprises a tubular base portion, an inflatable bladder and a plurality of overlying reinforcing slats each having end portions attached at end fittings on the tubular base. The inflatable packer also includes a continuous outer, annular, elastomeric cover having a longitudinal axis and extending for a length over at least a portion of an exterior surface of the plurality of reinforcing slats. The continuous elastomeric cover includes an alternating series of radially thick and thin annular portions along its length.

Further in accordance with the invention, the aforesaid elastomeric cover includes a radially thin portion adjacent at least one of the end fittings and is spaced from such end fitting.

Still further in accordance with the invention, at least a portion of the thin annular portions of the cover are bonded to at least a portion of the underlying reinforcing slats by bonding means.

Still further in accordance with the invention, an elastomer cover for an inflatable well packer has a longitudinal axis and extends for a length, the cover including an alternating series of radially thick and thin annular portions along its length.

It is therefore an object of this invention to provide a contoured elastomeric cover for an inflatable well packer which includes radially thin annular portion which act inhibit propagation of cracks or tears in the cover.

It is a further object of this invention to provide an outer cover for an inflatable packer which incorporates features which resist tearing or removal of the cover during and following an inflation/deflation cycle of the packer.

BRIEF DESCRIPTION OF THE DRAWINGS

The invention will now be described in greater detail with reference to the accompanying drawings forming a part of this specification and in which.

DETAILED DESCRIPTION OF THE PREFERRED EMBODIMENTS AND DRAWINGS

Figure 1:
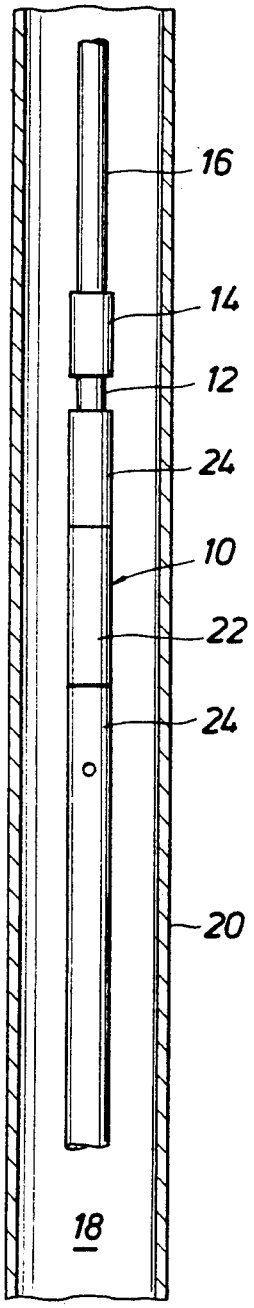
FIG. 1 is a schematic view of an inflatable packer in use prior to inflation.

Referring now to the drawings, wherein the showings are for the purposes of illustrating the preferred embodiment of the invention only and not for the purposes of limiting same, FIG. 1 schematically illustrates the inflatable packer device in its run-in condition prior to inflation. It will be understood that the inflatable packer may be one packing element of a bridge plug or only a single packer employed to isolate one part of a wellbore from another. The packer element 10 includes a tubular base portion 12 and is interconnected with a coupling number 14 to a tubular string 16 extending to the surface. It will be appreciated that the tubular string 16 can be formed by coupling individual sections of pipe or, in a preferred embodiment of the invention, a continuous length of coiled tubing inserted into the wellbore 18 having a casing 20.

The packer element 10 generally comprises an inflatable portion 22 with at least one and possibly two associated end fittings 24. It will be further understood that the inflatable packer may be associated with one or more downhole tools such as to effect the injection of various fluids into isolated portions of the wellbore 18.

Figure 2:
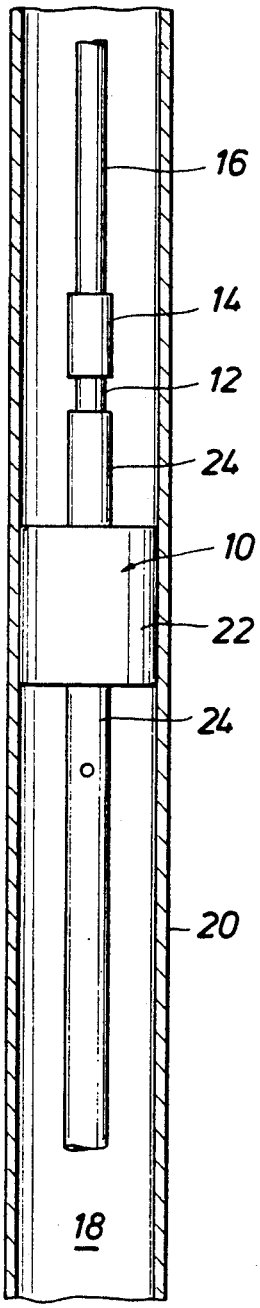
FIG. 2 is a schematic view similar to FIG. 1 showing the inflatable packer in the inflated condition.

At the point desired in the wellbore, the inflatable portion 22 of the packer element 10 is expanded through the application of fluid pressure to the interior of the inflatable portion and expanded outwardly into engagement with the casing 20 (FIG. 2). It will be understood that while the use of the inflatable packer of the present invention is shown in conjunction with a cased borehole, the inflatable packer may also be used in an uncased wellbore under appropriate conditions known to those skilled in the art.

Figure 3:
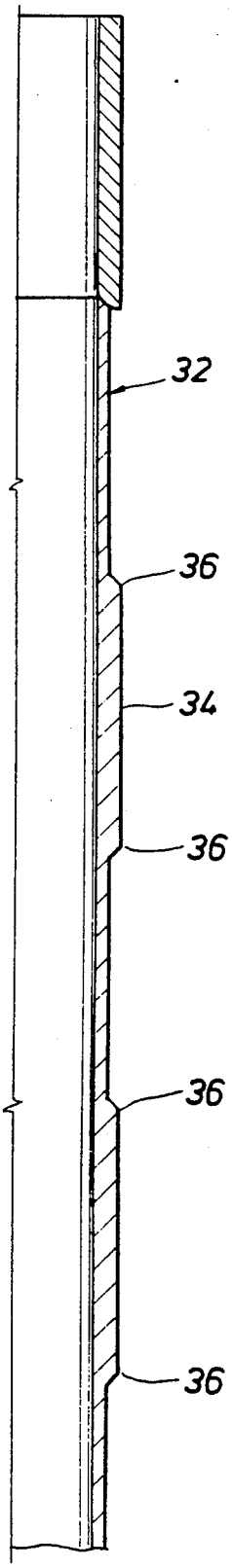
FIG. 3 is a cross-sectional view of a preferred contoured cover in accordance with the present invention.
Figure 4:
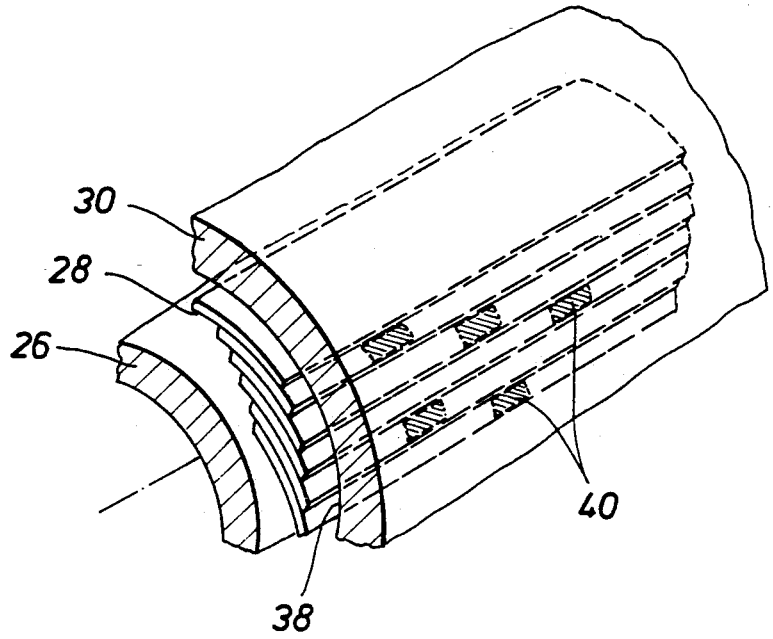
FIGS. 4 and 5 are isometric views in partial phantom showing alternative arrangements for bonding the cover to the inflatable packer in accordance with the present invention.
Figure 5:
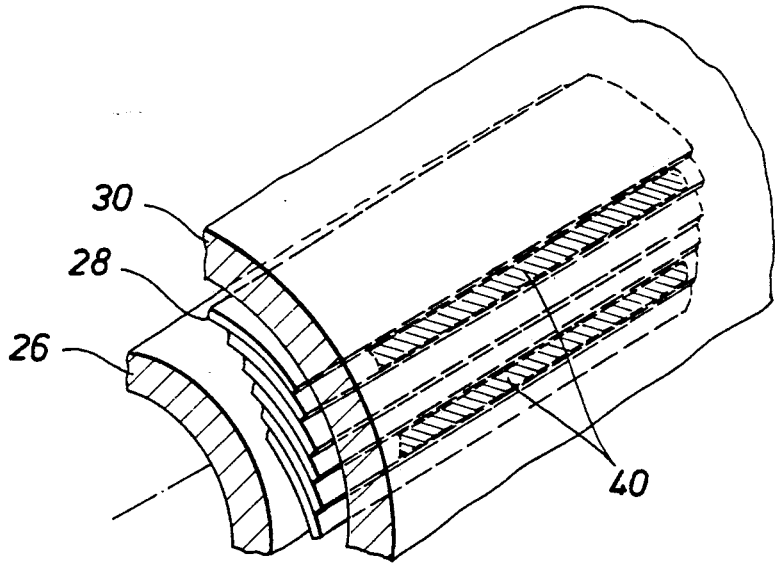

In accordance with the invention, the inflatable portion 22 of the packer element 10 comprises an inflatable bladder 26, a plurality of overlapping longitudinally oriented slats 28 and an elastomeric outer cover 30 (FIGS. 3 through 5). In accordance with a preferred embodiment of the invention, the outer cover 30 comprises a continuous body of elastomer having alternating thin and thick annular portions 32 and 34, respectively. As stated previously, the thin annular portions 32 act to retard or inhibit the propagation of cracks or tears into the thick annular portions 34 which effect sealing engagement of the outer cover 30 of the packer element 10 against the wellbore or casing in inflated condition.

The contoured elastomeric outer cover 30 of the present invention affords the additional advantage of providing plurality of points 36 of high contact stress at the longitudinally outer edges of the thick annular portions 34 (FIG. 3) these points of high contact stress 36 acting to greatly increase the sealing effectiveness of packer element 10.

In prior practice, it has been common to bond the outer cover 30 to adjacent exposed portion of the slats 28 along their entire length and around the complete cylindrical inner surface 38 of the elastomeric outer cover 30. FIGS. 4 and 5 illustrate two alternatives for effectively bonding the cover 30 to portions of the slats 28 to reduce the bonding stresses upon expansion of the inflatable packer while effectively retaining the cover 30 in a bonded condition with the slats 28. As shown in FIG. 4, bonding means 40 is applied on spaced portions of the exposed edges of adjacent slats in order to bond the outer cover 30 to the slats 28. In the alternative embodiment shown in FIG. 5, bonding means 40 is applied along the entirety of the exposed longitudinal length of only a portion of the exposed slats 28. There is no bonding of the outer cover 30 to any slats 28 which are immediately adjacent to each other. Thus, the bonding means 40 bonds the elastomeric outer cover 30 to a repeating series of non-adjacent slats 28. It will be understood that while the FIGURE illustrates bonding on every third slat, other alternating arrangements may be made such as every other slat, every fourth slat, every fifth slat, etc. The bonding scheme used here as illustrated in FIG. 4 and FIG. 5 can be selected by those skilled in the art in order to effect sufficient bonding to retain the outer cover 30 in a bonded condition to the slats 28 under the expected downhole conditions of use for the packer element 10.

Figure 6A:
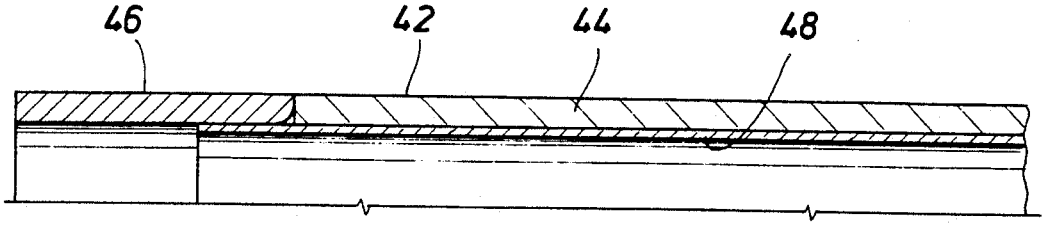
FIG. 6a (PRIOR ART)
FIGS. 6(*a*) and (*b*) illustrate the pre-inflation and post deflation condition of a PRIOR ART cover for an inflatable packer, respectively.
Figure 6B:
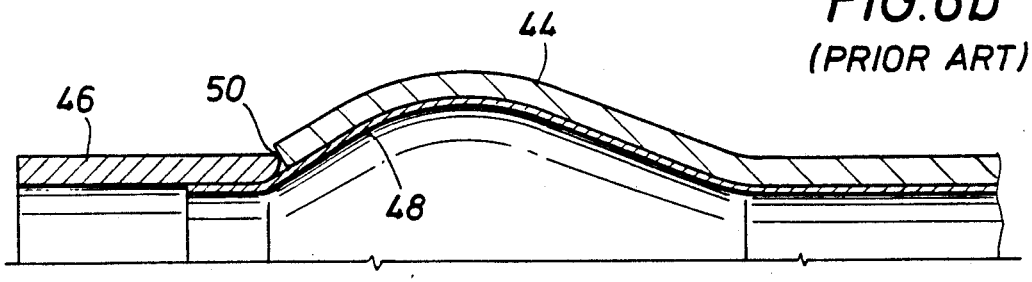
FIG. 6b (PRIOR ART)

One difficulty in current inflatable packers employing outer covers of uniform thickness is illustrated in FIGS. 6(*a*) and (*b*). In the initial, uninflated condition shown in FIG. 6(*a*), the outer surface 42 of the outer cover 44 presents a smooth, uniform diameter relative to the metal end fitting 46. However, following an inflation and deflation cycle as illustrated in FIG. 6(*b*), there is plastic deformation of the underlying slats and inflatable bladder portions 48 of the packer element leaving the outer cover and particularly the blunt end portion 50, thereof, in an enlarged, exposed condition. The blunt end portion 50 can easily snag against portions of the wellbore such as the edges of perforations, casing nipples and the like resulting in a tearing or possible entire removal of the outer cover 44 upon withdrawal of the packer element from the wellbore.

Figure 7A:
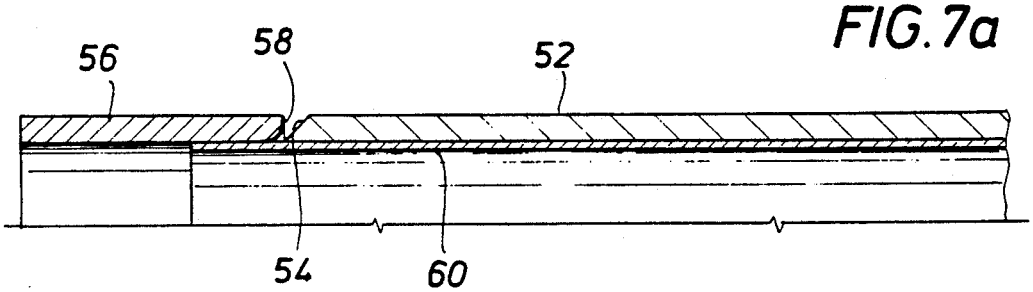
FIGS. 7(*a*), (*b*) and (*c*) illustrate the contoured cover in accordance with the present invention in the uninflated, inflated and post deflation conditions, respectively.
Figure 7B:
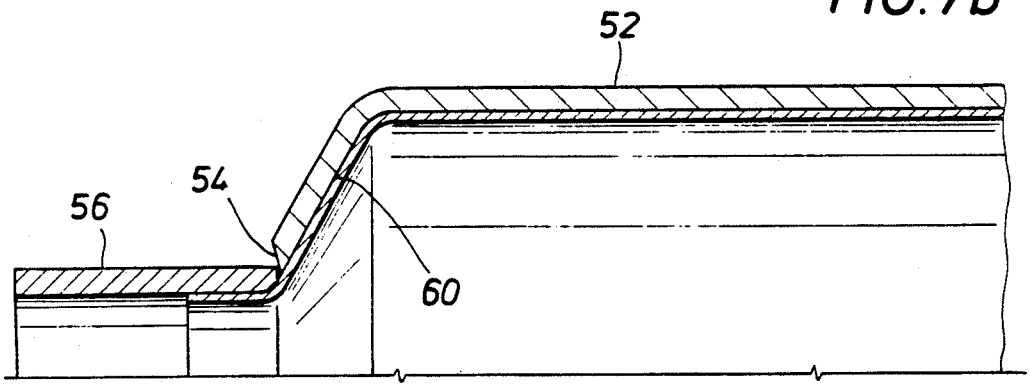
Figure 7C:
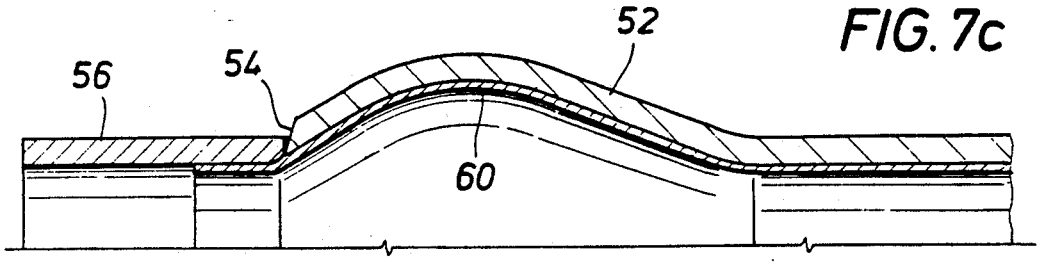

In accordance with the present invention, this problem is overcome as illustrated in FIGS. 7(*a*) through (*c*) by providing an outer cover 52 having a tapered end portion 54 adjacent the end fitting 56. As can be seen in FIG. 7(*c*), the post-deflation condition of the cover allows for a smoother transition at the tapered end portion 54 of the outer cover 52 presenting a significantly decreased likelihood of being snagged on portions of the wellbore.

As illustrated more clearly in FIGS. 7*a*) and (*b*), the tapered end portion 54 of the outer cover 52 is, in accordance with the preferred embodiment of the invention, spaced from the end fitting 56 by a length 58 which allows for plastic deformation of the underlying slats 60 without effecting the application of any or any significant longitudinal stress on the tapered end portion. This feature is an improvement over the abutment of the blunt end portion 50 (FIGS. 6*a*) and (*b*)) against the end fitting 46 which applies longitudinal stress to the cover 44 during the initial inflation expansion of the packer element.

While the invention has been described in the more limited aspects of the preferred embodiments thereof, other embodiments have been suggested and still others will occur to those skilled in the art upon a reading and understanding of the foregoing specification. It is intended that all such embodiments be included within the scope of this invention as limited only by the appended claims.

Having just described our invention, we claim:

1. An inflatable packer comprising a tubular base portion, an inflatable bladder and a plurality of overlying reinforcing slats each having end portions attached at end fittings on said tubular base and a continuous outer, annular, elastomeric cover having a longitudinal axis and extending for a length over at least a portion of said plurality of reinforcing slats, said continuous elastomeric cover including an alternating series of radially thick and thin annular portions along its length.

2. The inflatable packer as set forth in claim 1 wherein said cover has a radially thin portion adjacent at least one of said end fittings.

3. The inflatable packer as set forth in claim 2 wherein said radially thin portion of said cover is spaced from said end fitting.

4. The inflatable packer as set forth in claim 1 further including bonding means attaching at least said thin annular portions of said cover to said plurality of slats.

5. The inflatable packer as set forth in claim 4 wherein said bonding means attaches said cover to less than all of said slats.

6. The inflatable packer as set forth in claim 4 wherein said bonding means attaches said cover to said plurality of slats at longitudinally spaced locations on adjacent slats.

7. In an inflatable well packer having an inner bladder, and a plurality of overlying reinforcing slats, a continuous outer annular, sealing, elastomeric cover having a longitudinal axis and extending for a length over the reinforcing slats, comprising an alternating series of radially thick and thin annular portions of said elastomeric cover along its length.

8. The elastomeric cover as set forth in claim 7 wherein the cover has a radially thin portion adjacent an end fitting of said packer.

9. The elastomeric cover as set forth in claim 8 wherein said radially thin portion of said cover is spaced from said end fitting.

10. The elastomeric cover as set forth in claim 7 further including bonding means attaching at least said thin annular portions of said cover to said plurality of slats.

11. The elastomeric cover as set forth in claim 10 wherein said bonding means attaches said cover to less than all of said plurality of slats.

12. The elastomeric cover as set forth in claim 10 wherein said bonding means attaches said cover to said plurality of slats at longitudinally spaced locations on adjacent slats.

* * * * *